US006616582B1

(12) United States Patent
Jiang

(10) Patent No.: US 6,616,582 B1
(45) Date of Patent: Sep. 9, 2003

(54) BELLY EXERCISER

(76) Inventor: Zhi-Yu Jiang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/139,742

(22) Filed: May 3, 2002

(51) Int. Cl.[7] ..... A63B 26/00
(52) U.S. Cl. ..... 482/140
(58) Field of Search ..... 482/96, 908, 140, 482/148, 121–123, 129–130, 133–134, 139

(56) References Cited

U.S. PATENT DOCUMENTS 5,232,425 A * 8/1993 Miller et al. ..... 482/121
5,637,066 A * 6/1997 Chang ..... 482/126
5,964,685 A * 10/1999 Boland ..... 482/122
6,296,598 B1 * 10/2001 Boland ..... 482/126
6,494,819 B1 * 12/2002 Boland ..... 482/130

* cited by examiner

*Primary Examiner*—Nicholas D. Lucchesi
*Assistant Examiner*—Lori Baker Amerson

(57) ABSTRACT

A belly exerciser has a pressing board, a shaft, a main body, a rotating disk, a bowl, a pair of connecting sleeves, and a pair of handle bars. The main body has an outer ring, and a main tube having a cross-shaped groove. The pressing board is disposed on the shaft. The shaft is inserted through the main tube. A compression spring is disposed between the pressing board and the outer ring to surround the shaft. A connecting rod is connected to the shaft. A connector is connected to an end of the connecting rod. A post is disposed on the connecting rod. The bowl is disposed on the connector. The rotating disk has an annular center flange to engage with the bowl. The connecting sleeves are disposed on the outer ring to receive the handle bars.

5 Claims, 6 Drawing Sheets

BELLY EXERCISER

BACKGROUND OF THE INVENTION

The present invention relates to a belly exerciser. More particularly, the present invention relates to a belly exerciser which exercises a belly and a waist of a user.

A conventional belly exerciser cannot be rotated. Therefore, a hula hoop will provide more physical energy consumption for a user than a conventional belly exerciser does.

SUMMARY OF THE INVENTION

An object of the present invention is to provide a belly exerciser which exercises a belly and a waist of a user effectively. Therefore, the belly exerciser of the present invention provides more physical energy consumption for a user than a conventional belly exerciser does.

Accordingly, a belly exerciser comprises a pressing board, a shaft, a main body, a rotating disk, a bowl, a pair of connecting sleeves, and a pair of handle bars. The main body has an outer ring, a main tube communicating with the outer ring, and the main tube having a cross-shaped groove. The pressing board is disposed on the shaft. The shaft is inserted through the main tube. A compression spring is disposed between the pressing board and the outer ring to surround the shaft. A connecting rod is connected to the shaft. A connector is connected to an end of the connecting rod. A post is disposed on the connecting rod. The bowl is disposed on the connector. The rotating disk has an annular center flange to engage with the bowl. The connecting sleeves are disposed on the outer ring. Each of the connecting sleeves receives the corresponding handle bar.

DETAILED DESCRIPTION OF THE INVENTION

Figure 1:
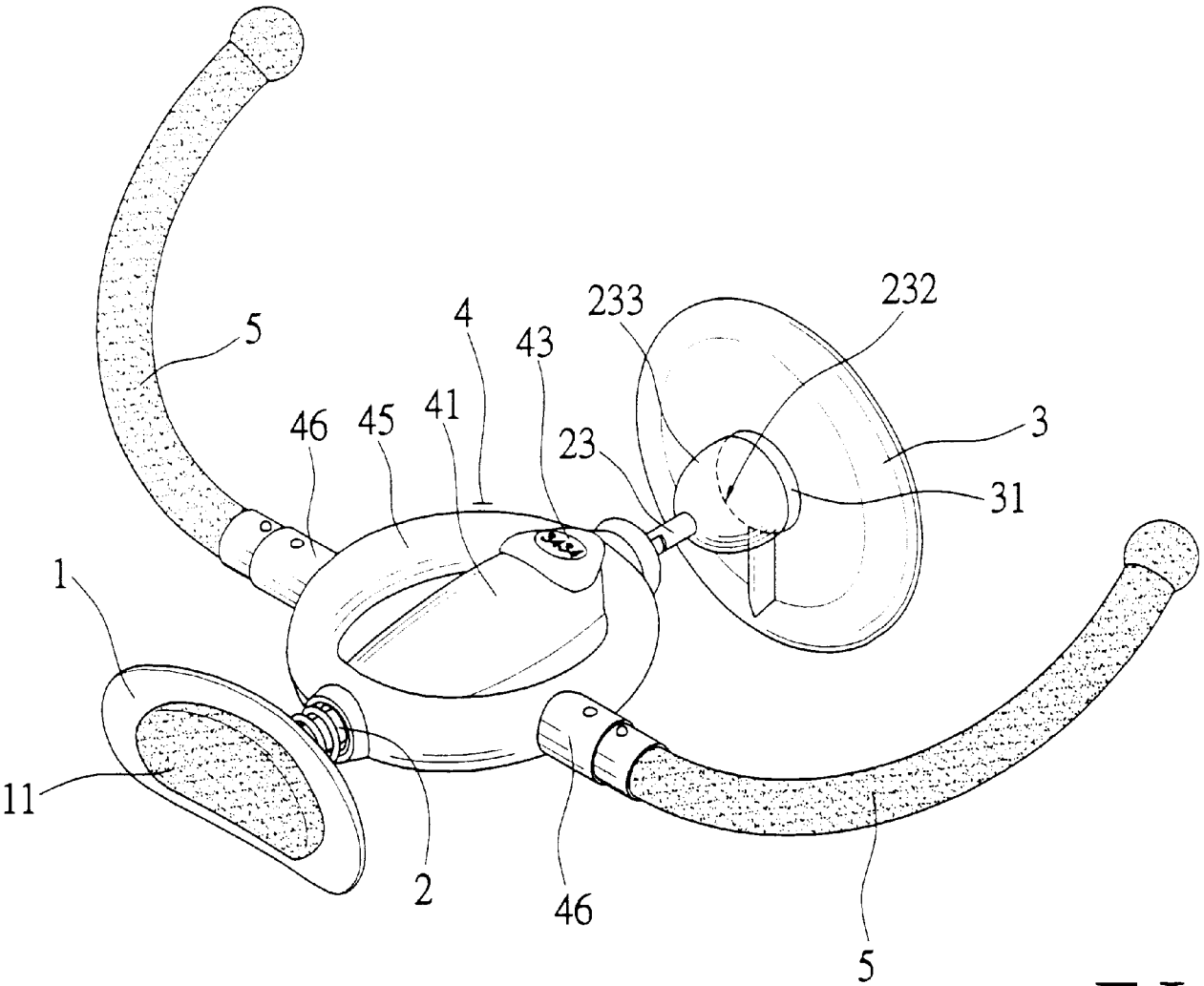
FIG. 1 is a perspective view of a belly exerciser of a preferred embodiment in accordance with the present invention.
Figure 2:
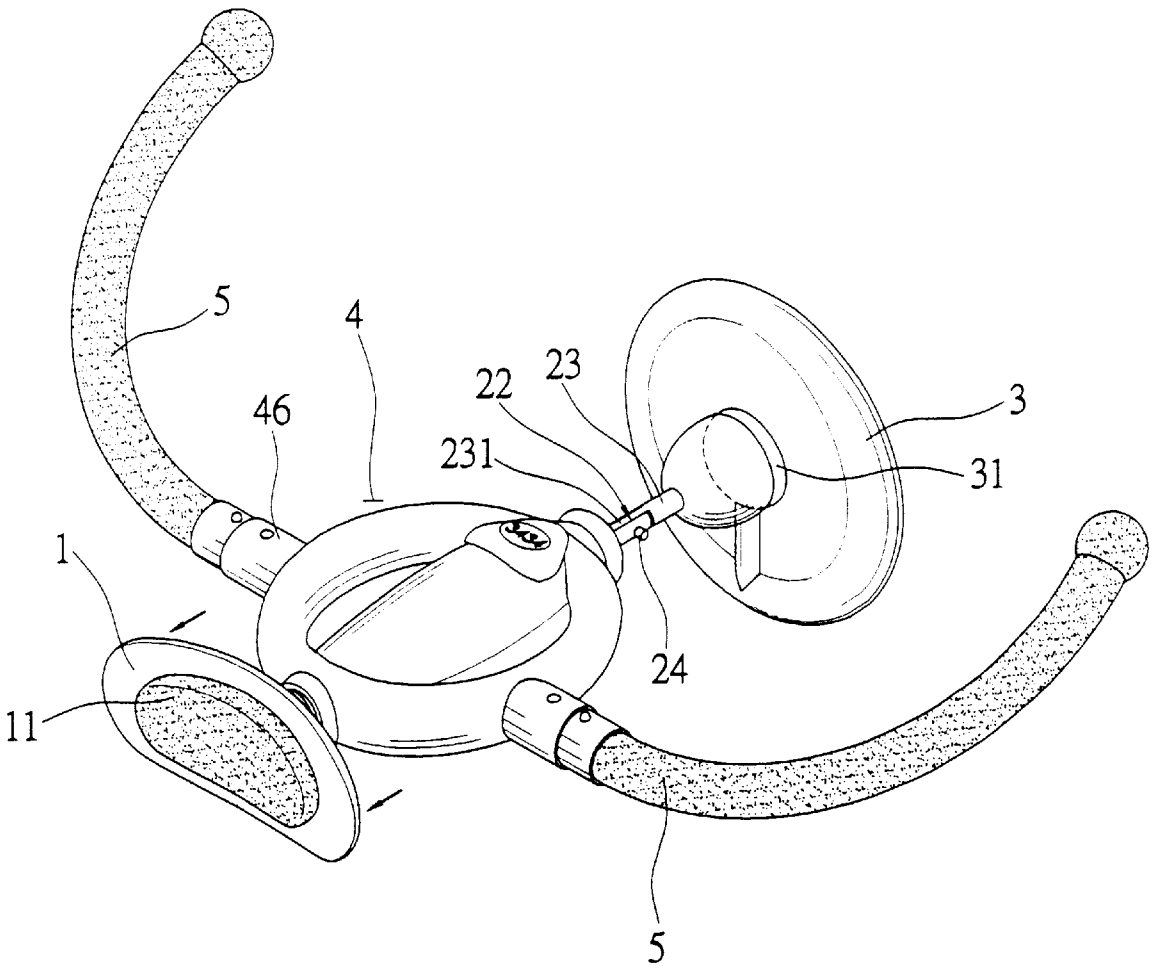
FIG. 2 is a schematic view illustrating a main body of a belly exerciser of a preferred embodiment is moved toward a pressing board.
Figure 3:
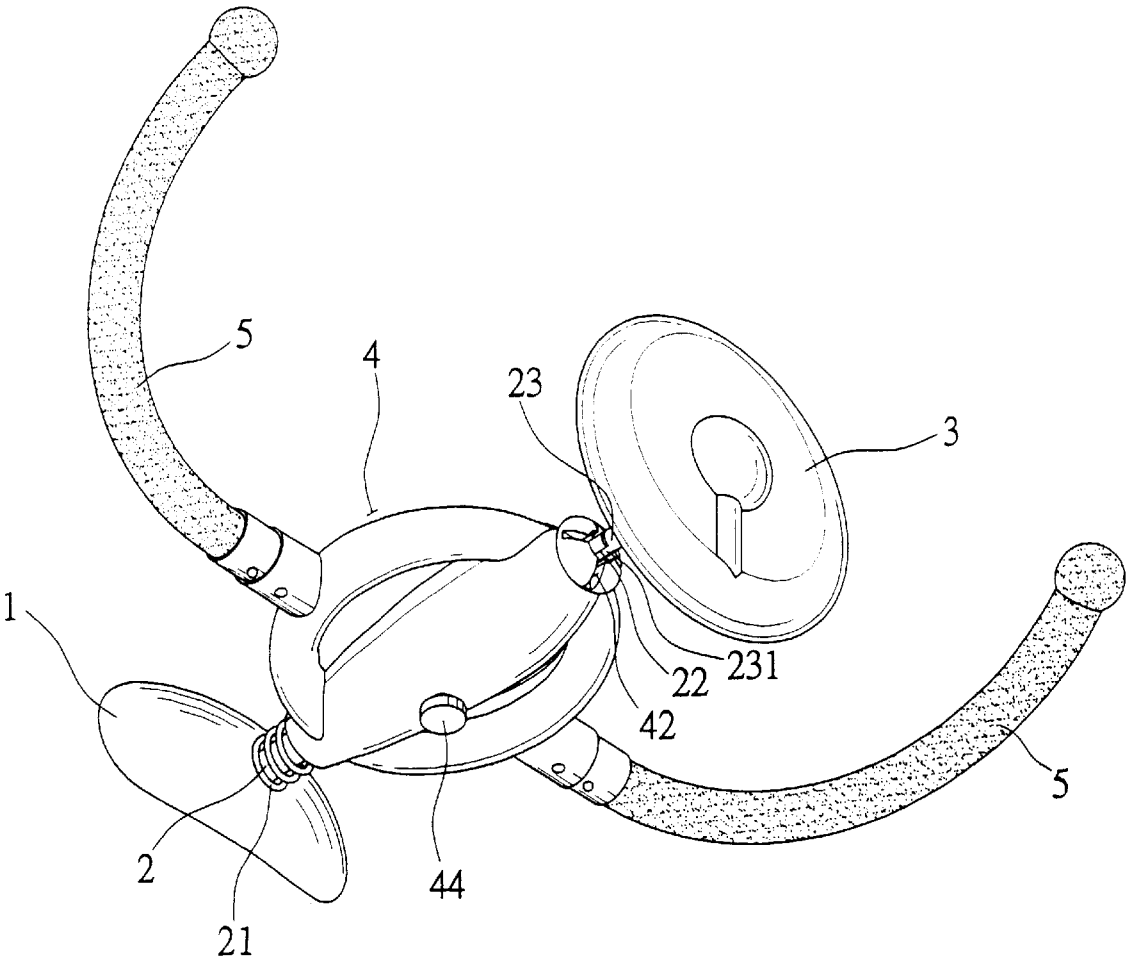
FIG. 3 is another perspective view of FIG. 1.
Figure 4:
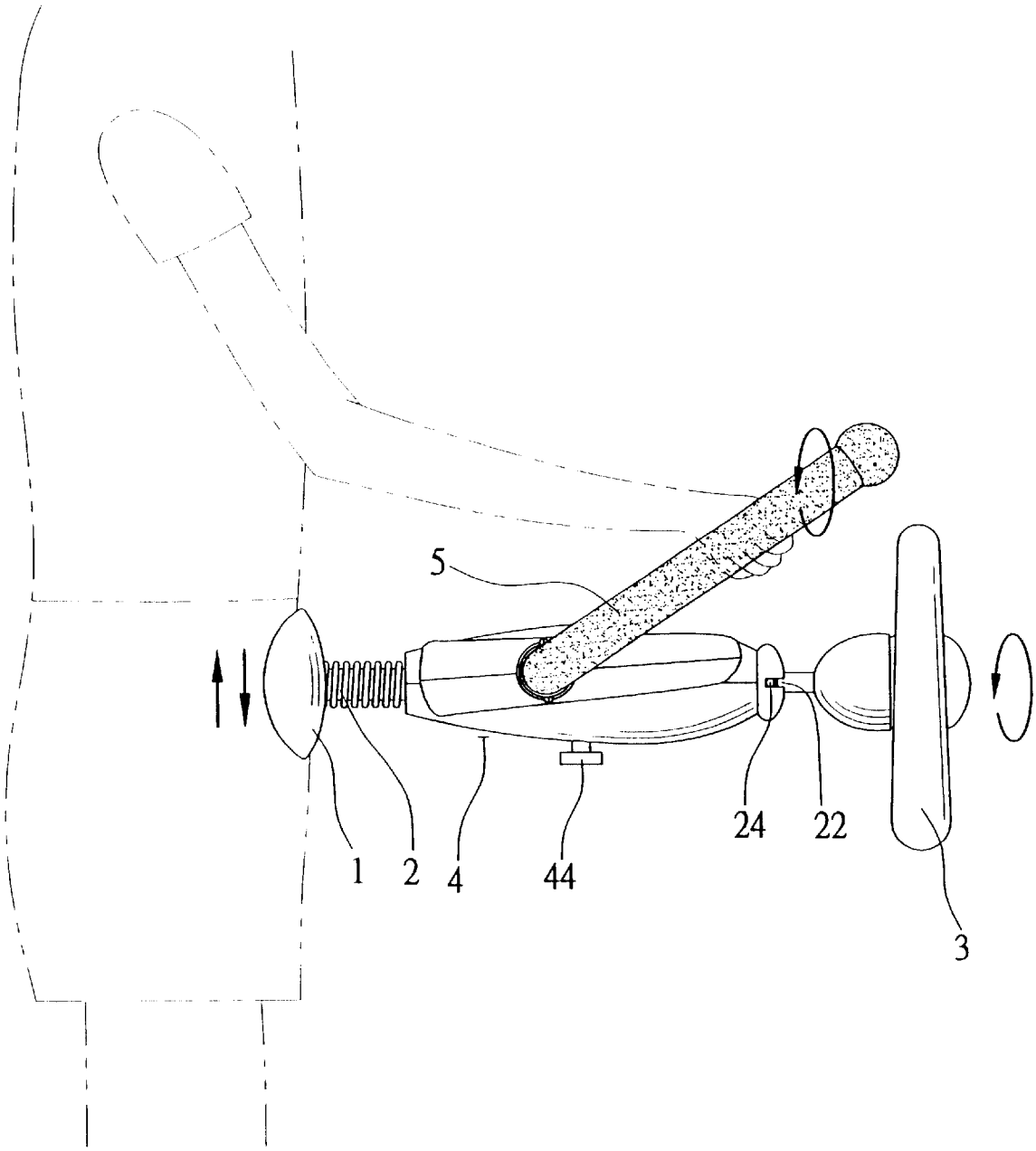
FIG. 4 is a schematic view illustrating a pressing board of a preferred embodiment is moved upward and downward.
Figure 5:
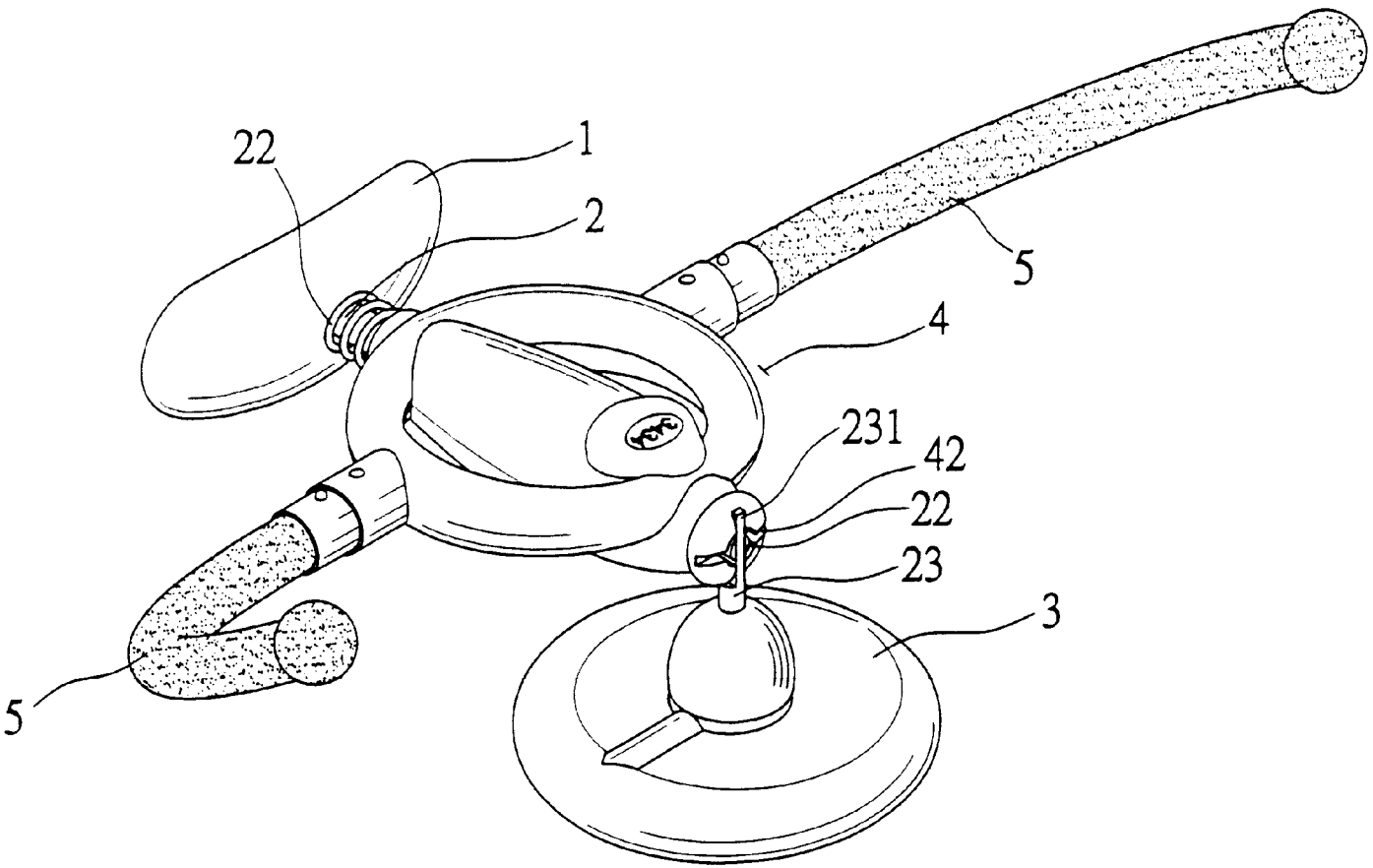
FIG. 5 is a perspective view of a belly exerciser of a preferred embodiment while a rotating disk is moved downward.
Figure 6:
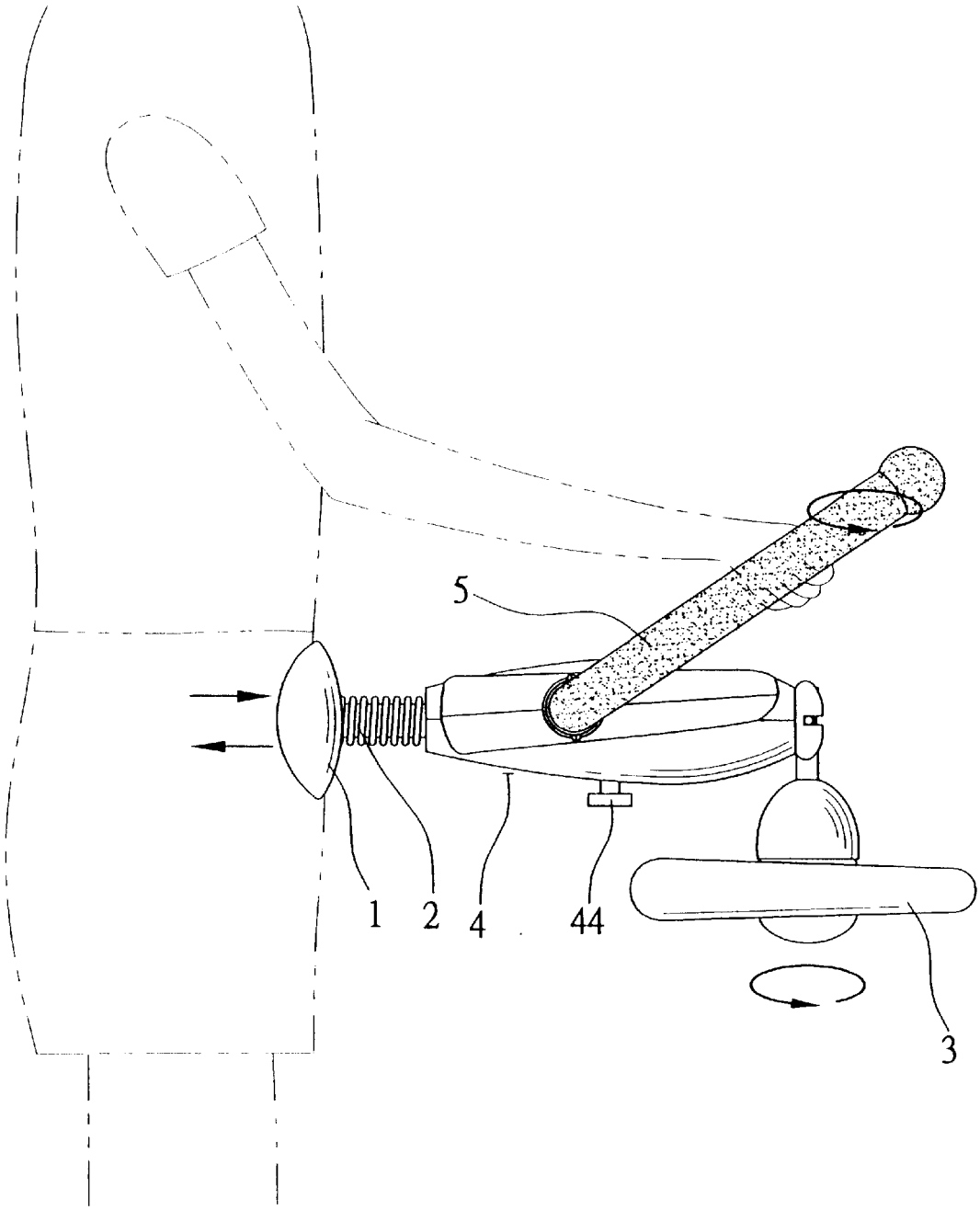
FIG. 6 is a schematic view illustrating a belly exerciser of a preferred embodiment is pressed toward a user.

Referring to FIGS. 1 to 6, a belly exerciser comprises a pressing board 1, a shaft 2, a main body 4, a rotating disk 3, a bowl 233, a pair of connecting sleeves 46, and a pair of handle bars 5.

The main body 4 has an outer ring 45, a main tube 41 communicating with the outer ring 45, and the main tube 41 having a cross-shaped groove 42.

The pressing board 1 is disposed on the shaft 2.

The shaft 2 is inserted through the main tube 41. A compression spring 21 is disposed between the pressing board 1 and the outer ring 45 to surround the shaft 2.

A connecting rod 231 is connected to the shaft 2.

A connector 23 is connected to an end of the connecting rod 231.

A post 24 is disposed on the connecting rod 231.

The bowl 233 is disposed on the connector 23.

The rotating disk 3 has an annular center flange 31 to engage with the bowl 233.

The connecting sleeves 46 are disposed on the outer ring 45.

Each of the connecting sleeves 46 receives the corresponding handle bar 5.

The shaft 2 has an end notch 22.

A pad 11 is disposed on the pressing board 1.

A fastening button 44 is disposed on the main tube 41.

A digital display 43 is disposed on the main tube 41.

The bowl 233 has an inner interior 232.

When the main body 4 is moved toward the pressing board 1, the post 24 is inserted in the cross-shaped groove 42 of the main tube 41. Then the pressing board 1 is moved toward a belly of a user.

When the rotating disk 3 is moved downward, the connecting rod 231 is inserted in the cross-shaped groove 42 of the main tube 41. Then the pressing board 1 rotates a belly of a user.

The belly exerciser of the present invention has the following advantages. The rotating disk 3 can be turned downward. A user holds two handle bars 5 to operate the belly exerciser easily. The belly exerciser of the present invention provides a physical energy consumption for a user similar to a physical energy consumption provided by a hula hoop.

The invention is not limited to the above embodiment but various modification thereof may be made. Further, various changes in form and detail may be made without departing from the scope of the invention.

I claim:

1. A belly exerciser comprises:

a pressing board, a shaft, a main body, a rotating disk, a bowl, a pair of connecting sleeves, and a pair of handle bars, the main body having an outer ring, a main tube communicating with the outer ring, and the main tube having a cross-shaped groove, the pressing board disposed on the shaft, the shaft inserted through the main tube, a compression spring disposed between the pressing board and the outer ring to surround the shaft, a connecting rod connected to the shaft, a connector connected to an end of the connecting rod, a post disposed on the connecting rod, the bowl disposed on the connector, the rotating disk having an annular center flange to engage with the bowl, the connecting sleeves disposed on the outer ring, and each of the connecting sleeves receiving the corresponding handle bar.

2. The belly exerciser as claimed in claim 1, wherein the shaft has an end notch.

3. The belly exerciser as claimed in claim 1, wherein a pad is disposed on the pressing board.

4. The belly exerciser as claimed in claim 1, wherein a fastening button is disposed on the main tube.

5. The belly exerciser as claimed in claim 1, wherein a digital display is disposed on the main tube.

* * * * *